United States Patent [19]

Arnold et al.

[11] Patent Number: 4,653,450

[45] Date of Patent: Mar. 31, 1987

[54] ARRANGEMENT FOR THE METERING OF FUEL IN AN INTERNAL COMBUSTION ENGINE

[75] Inventors: Herbert Arnold, Eberdingen; Werner Jundt, Ludwigsburg; Siegfried Malicki, Ingersheim; Peter Werner, Wiernsheim, all of Fed. Rep. of Germany

[73] Assignee: Robert Bosch GmbH, Stuttgart, Fed. Rep. of Germany

[21] Appl. No.: 734,282

[22] PCT Filed: Jul. 25, 1984

[86] PCT No.: PCT/DE84/00159

§ 371 Date: May 8, 1985

§ 102(e) Date: May 8, 1985

[87] PCT Pub. No.: WO85/01083

PCT Pub. Date: Mar. 14, 1985

[30] Foreign Application Priority Data

Sep. 8, 1983 [DE] Fed. Rep. of Germany ..... 3332399

[51] Int. Cl.[4] ..... F02D 43/00

[52] U.S. Cl. ..... 123/479; 123/475; 123/491

[58] Field of Search ..... 123/479, 491, 475

[56] References Cited

U.S. PATENT DOCUMENTS

| | | | |
|---|---|---|---|
| 3,834,361 | 9/1974 | Keely | 123/479 |
| 4,370,962 | 2/1983 | Hosaka | 123/479 |
| 4,517,952 | 5/1985 | Hosoya | 123/475 |

FOREIGN PATENT DOCUMENTS

| | | |
|---|---|---|
| 0065221 | 11/1982 | European Pat. Off. . |
| 58-144664 | 8/1983 | Japan . |
| WO80/00597 | 4/1980 | PCT Int'l Appl. . |
| 2074758 | 11/1981 | United Kingdom . |

*Primary Examiner*—Andrew M. Dolinar
*Attorney, Agent, or Firm*—Walter Ottesen

[57] ABSTRACT

The invention is directed to an arrangement for metering fuel to a spark-ignition internal combustion engine equipped with a fuel injection system. The fuel metering arrangement includes a control apparatus which generates injection pulses for controlling the injection valves, the pulses being generated at least in dependence upon the rotational speed of the engine. In the event of a failure of the control apparatus, control of the injection valves is switched over to injection pulses derived from the ignition system of the engine. In this arrangement, the transfer of control may be accomplished either by pulling the central plug of the control apparatus or by automatic error detection via a speed relay.

4 Claims, 3 Drawing Figures

ARRANGEMENT FOR THE METERING OF FUEL IN AN INTERNAL COMBUSTION ENGINE

FIELD OF THE INVENTION

The invention relates to an arrangement for metering fuel to a spark-ignition internal combustion engine equipped with a fuel injection system.

BACKGROUND OF THE INVENTION

Such arrangements include as an essential component a control apparatus having its functions either hard-wired or freely programmable using, for example, a microcomputer. Control apparatus of this type have been already described in detail in pertinent technical literature and belong to the state-of-the-art for a long time. These control apparatus are well proven in practice with respect to road behavior and exhaust emission of the internal combustion engine.

On the other hand, the relatively complicated configuration of these control apparatus can lead to possible failure of individual components. A malfunction in a secondary component may tie up the function of the entire control apparatus and thus also the internal combustion engine. To circumvent this disadvantage, many suggestions have already been made as, for example, in patent application WO No. 80/00597. In this patent application, it is suggested that the control apparatus be provided with at least one sensor-controlled auxiliary device the output signals of which, alternatively to the output signals of the control apparatus, are adapted to be applied via a switch-over device to final control stages, for example, to the final control stages of an electric injection system. In this arrangement, the auxiliary devices are controlled by the output signals of the same sensor which is also connected to the control apparatus.

SUMMARY OF THE INVENTION

In contrast to the solutions suggested above, the arrangement of the invention affords the advantage of permitting an emergency mode of operation in the event of a failure of the control apparatus without requiring the use of such relatively complex auxiliary devices. In lieu of the output signals of such auxiliary devices, the signals of the ignition system are utilized for the control of the fuel injection valves. This permits the implementation of an extremely cost-effective emergency operation concept enabling the operator of a motor vehicle equipped in this manner to reach the nearest service station under a kind of emergency operating condition also in the event of a failure of the control apparatus.

Another advantage is that the ignition signals are derived from a generator which does not act upon the control apparatus. Consequently, this system will also prove effective when a generator providing the main input quantities of the control apparatus fails.

Particularly the simple coupling of the ignition system with the injection system via a diode and a simple selector switch is especially simple and cost effective. This feature is particularly advantageous in cases where such an arrangement is to be retrofitted to already existing control apparatus.

BRIEF DESCRIPTION OF THE DRAWING

The invention will now be described with reference to the drawing wherein.

DESCRIPTION OF THE PREFERRED EMBODIMENTS OF THE INVENTION

Figure 1:
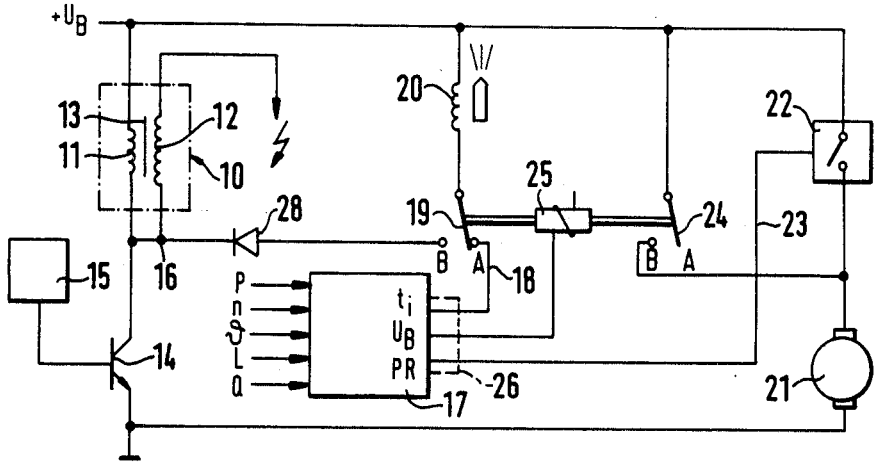
FIG. 1 is a schematic of an arrangement according to the invention for metering fuel to an internal combustion engine.

In FIG. 1, reference numeral 10 identifies an ignition coil which includes a primary winding 11, a secondary winding 12 and an iron core 13. Primary winding 11 is inserted between the battery voltage $U_B$ and the collector of a transistor 14 which has its emitter connected to ground potential. Applied to the base of transistor 14 is the output of an ignition pulse generator 15 which may be configured as a mechanical interrupter, induction generator, Hall generator, Wiegand generator or also an an optical generator, for example. The input of secondary winding 12 of ignition coil 10 is connected to circuit node 16 between the primary winding 11 and the collector of transistor 14. On its output side, the high-voltage ignition signals are conducted to an ignition system not shown in further detail.

A control apparatus is identified by reference numeral 17 and has inputs to which data are supplied on various operating parameters such as pressure p, engine rotational speed n, temperature $\theta$, load information L or inducted air or injected fuel quantity Q. The control apparatus 17 supplies injection pulses to an injection valve 20 via a line 18 and a switch 19 which is shown in position A. It is understood that the arrangement of the invention is equally suitable for use also in systems including several injection valves. The output end of injection valve 20 is connected to battery voltage $U_B$. With switch 19 in position B, a connection is established between circuit node 16 and injection valve 20 via a diode 28.

A fuel pump is identified by reference numeral 21 and receives its supply voltage $U_B$ via a switch 22. The fuel pump 21 is connected to ground potential at its other terminal. Switch 22 is connected to control apparatus 17 via a control line 23. The circuit node between fuel pump 21 and switch 22 may likewise be connected to the potential of supply voltage $U_B$ via a further line interrupted by a switch 24. Switches 19 and 24 are actuated by a relay 25 which is activated by the application of battery voltage $U_B$ via a line connected to the control apparatus 17. With relay 25 activated, switches 19 and 24 are in the position identified by A. The output lines of control apparatus 17 may be disconnected from the control apparatus by a central plug 26.

In the normal case of a trouble-free operation of control apparatus 17, relay 25 is activated by the application of battery voltage $U_B$ via central plug 26. The injection pulses of the control apparatus 17 are conducted via line 18 and switch 19 (in position A) to the injection valves. Switch 22 is closed via control line 23, and fuel pump 21 delivers the fuel to the injection valves 20 via fuel lines not shown.

The ignition operates independently of the function of the control apparatus and supplies the appropriate ignition pulses to the spark plugs (not shown) of the internal combustion engine.

In the event of a serious malfunction of control apparatus 17 in which functioning of the internal combustion engine is no longer ensured, the emergency mode of operation may be activated by pulling the central plug 26 from the control apparatus. This measure is a very special embodiment; it is also possible to disconnect the output lines of the control apparatus via a switch mounted in the motor vehicle.

In any case, switch 22 is then opened, thereby disconnecting the fuel pump 21 from the supply voltage. On the other hand, relay 25 switches into its inactive position, that is, the two switches 19 and 24 switch to position B. As a result, injection valve 20 is connected via switch 19 (in position B) and diode 28 to circuit node 16. The voltage supply for fuel pump 21 is reestablished via the second switch 24 (in position B).

If transistor 14 conducts, the ignition system is in the "inductive ignition energy storage" phase. With transistor 14 conducting, circuit node 16 is connected approximately to ground potential and injection valve 20 is actuated via conductive diode 28. If, however, transistor 14 is cut off by ignition pulse generator 15 for the purpose of generating an ignition spark, high positive voltages will occur at circuit node 16 causing diode 28 to be cut off and thereby close injection valve 20. In this manner, the injection valve 20 and the spark plugs are actuated alternately.

For embodiments in which switch 22 is not actuated by control apparatus 17 but by other independent components, switch 24 may be omitted.

Figure 2:
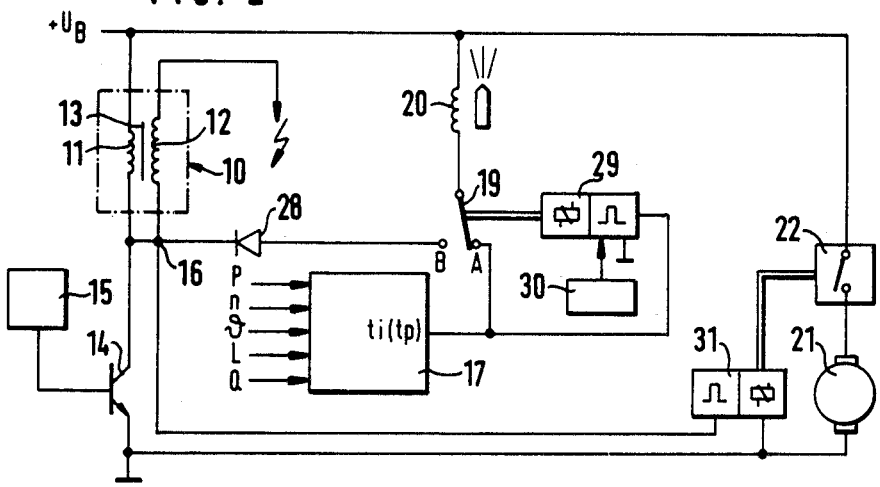
FIG. 2 is a schematic of an alternate embodiment of the arrangement according to the invention; and, FIG. 3 is a schematic of still another embodiment of the invention.

In the embodiment of FIG. 2, like components have been assigned like reference numerals. In the following, only the differences from the embodiment of FIG. 1 will be explained in more detail.

As in the foregoing, injection pulses $t_i$ or load signals $t_p$ are conducted to injection valve 20 via switch 19 (in position A). In addition, these signals are also applied to a rotational speed relay 29 for actuating switch 19. This speed relay 29 may further receive start signal information from a start signal generator 30. In this embodiment, switch 22 for interrupting the supply voltage is not actuated by control apparatus 17 but by a speed relay 31 which is connected to circuit node 16 at its input.

These speed relays 29 and 31 are known per se and switch when the pulse repetition frequency present at their inputs drops below a specific value, that is, the relays change their output quantity or actuate the contacts corresponding thereto. The relay is acted upon by an electronic timing stage configured either as a retriggerable monostable multivibrator or as a retriggerable timer. When the battery voltage is applied, the timing element is set, the relay picks up for a determined period of time and drops out again when no pulses occur. This time period is selected so that it is greater than the pulse spacing at the lowest rotational speed. In addition, the relay is actuated immediately in the event of a malfunction.

With the engine running, the ignition pulses constantly retrigger the speed relay, thereby preventing the set time from elapsing and maintaining the relay in its activated state. In the present embodiment, the switching threshold for the pulse repetition frequency is in the neighborhood of 1 Hz, it may, however, also assume other values adapted to the particular vehicle involved. For safety reasons, speed relay 31 will cut off the fuel supplied by fuel pump 21 when the ignition pulse train drops below the set threshold value.

In the present embodiment, a failure of control apparatus 17 is detected by speed relay 29. In the absence of injection pulses or when the injection pulses drop below a predeterminable number per unit of time, speed relay 29 will switch the switch 19 into position B, thus causing, in the same manner as in the embodiment of FIG. 1, the injection valve 20 to be actuated via diode 28 by the pulses of the ignition system at circuit node 16. For starting, a start signal generator 30 is provided which prevents the rotational speed relay 29 from responding during the start phase.

In the embodiment of FIG. 2, transfer of control to the "emergency mode of operation" thus occurs automatically, that is, it is detected by speed relay 29.

Figure 3:
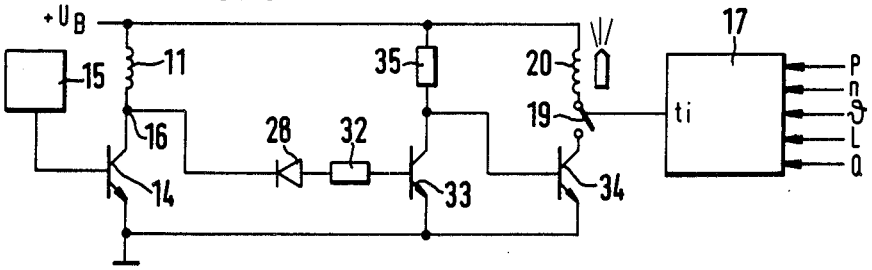

The embodiment of FIG. 3 provides for an active decoupling between primary winding 11 of ignition coil 10 and injection valve 20. In this embodiment, too, like components are assigned like reference numerals. Components which are not essential to the explanation of the mode of operation to this embodiment are not illustrated, but it is understood that this arrangement is suitable for use in any one of the previous embodiments.

With switch 19 in position B, operation is in the emergency mode, and injection valve 20 is no longer directly connected to diode 28. The signals of the ignition system are conducted from circuit node 16 via diode 28, a resistor 32, the base-collector path of a transistor 33, the base-collector path of another transistor 34 and switch 19 (position B) to injection valve 20. The collector of transistor 33 is connected to supply voltage $U_B$ via a resistor 35; whereas, the emitters of transistors 33 and 34 are connected to ground potential. This circuit arrangement known per se affords the advantage of hardly putting a load on primary winding 11 of ignition coil 10, thereby providing a sufficient decoupling between injection valve 20 and the ignition system.

As an alternative arrangement and during the "emergency mode of operation", only half of the normally operating injection valves could be actuated so that a sufficient ignition energy would be available.

In the event of the emergency mode of operation, it is particularly advantageous to increase the supply of air to the internal combustion engine by using auxiliary-air devices or bypasses that may be mounted in the intake pipe. This compensates for the enriched air-fuel mixture resulting from multiple injections occurring in the emergency mode of operation, so that a well ignitable mixture is available to the internal combustion engine.

It is understood that the foregoing description is that of the preferred embodiments of the invention and that various changes and modifications may be made thereto without departing from the spirit and scope of the invention as defined in the appended claims.

We claim:

1. Arrangement for metering fuel to an internal combustion engine equipped with a fuel injection system including fuel-injection valve means, the arrangement comprising:

a control apparatus for generating a train of fuel injection pulses for actuating said fuel-injection valve means at least in dependence upon the rotational speed of the engine;

ignition pulse generator means for generating ignition pulses;

ignition coil means for storing energy required to generate an ignition spark for the engine;

a transistor serially connected with said ignition coil means to conjointly define a current circuit therewith, said transistor being responsive to said ignition pulses for closing and opening said current circuit whereby said ignition coil means releases said energy for generating said ignition spark when said current circuit is opened; and, switching means for switching said fuel-injection valve means from said control apparatus and connecting the same to said transistor in the event of a malfunction of said control apparatus thereby causing said transistor to directly control the current through said fuel-injection valve means in response to said ignition pulses.

2. The arrangement of claim 1 comprising: disconnect means actuable for disconnecting said control apparatus from said fuel-injection valve means; and, said switching means including a switch movable between a first position whereat said fuel-injection valve means is connected to said control apparatus and a second position whereat said fuel-injection valve means is connected directly to said transistor and, actuation means for actuating said switch to switch the same from said first position to said second position in response to an actuation of said disconnect means.

3. The arrangement of claim 2, said actuation means being a speed relay for actuating said switch, said speed relay being connected to said control apparatus for receiving said fuel injection pulses and being adapted to actuate said switch when said train of said pulses drops below a predeterminable minimal value.

4. Arrangement for metering fuel to an internal combustion engine equipped a fuel injection system including fuel-injection valve means, the arrangement comprising:

a control apparatus for generating a train of fuel injection pulses for actuating said fuel-injection valve means at least in dependence upon the rotational speed of the engine;

circuit means for deriving fuel injection pulses from said spark-ignition system;

switching means for switching said valve means from said control apparatus to said circuit means in the event of a malfunction of said control apparatus thereby causing said fuel-injection valve means to be actuated by fuel injection pulses from said spark-ignition system during said malfunction;

disconnect means actuable for disconnecting said control apparatus from said fuel-injection valve means; and, said switching means including a switch movable between a first position whereat said fuel-injection valve means is connected to said control apparatus and a second position whereat said fuel-injection valve means is connected to said spark-ignition system and, actuation means for actuating said switch to switch the same from said first position to said second position in response to an actuation of said disconnect means;

said actuation means being a speed relay for actuating said switch, said speed relay being connected to said control apparatus for receiving said fuel injection pulses and being adapted to actuate said switch when said train of said pulses drops below a predeterminable minimal value; and, means for disabling said speed relay during the start condition.

* * * * *

UNITED STATES PATENT AND TRADEMARK OFFICE

CERTIFICATE OF CORRECTION

PATENT NO. : 4,653,450

DATED : March 31, 1987

INVENTOR(S) : Herbert Arnold et al

It is certified that error appears in the above-identified patent and that said Letters Patent is hereby corrected as shown below:

Column 2, line 24, "an an" should read -- as an --.

Column 5, line 34, after "equipped" insert -- with --.

Signed and Sealed this

Tenth Day of May, 1988

*Attest:*

DONALD J. QUIGG

*Attesting Officer*

*Commissioner of Patents and Trademarks*